United States Patent [19]

Mair

[11] 4,244,446

[45] Jan. 13, 1981

[54] ADJUSTABLE LADDER SUPPORT

[76] Inventor: George R. Mair, 7785 Cote de Liesse, St. Laurent, Quebec, Canada, H4T 1G3

[21] Appl. No.: 84,853

[22] Filed: Oct. 15, 1979

[30] Foreign Application Priority Data

Oct. 20, 1978 [CA] Canada ..... 313847

[51] Int. Cl.[3] ..... E06C 1/16

[52] U.S. Cl. ..... 182/172; 182/204

[58] Field of Search ..... 182/172, 204, 205, 107, 182/108

[56] References Cited

U.S. PATENT DOCUMENTS

| | | | |
|---|---|---|---|
| 1,251,761 | 1/1918 | Enke | 182/172 |
| 1,385,319 | 7/1921 | Enke | 182/172 |
| 3,508,628 | 4/1970 | Conrad | 182/172 |
| 3,856,112 | 12/1974 | Stewart | 182/172 |
| 3,878,917 | 4/1975 | McBride | 182/172 |
| 4,147,231 | 4/1979 | Chantler | 182/172 |

FOREIGN PATENT DOCUMENTS 967532 5/1975 Canada .

*Primary Examiner*—Reinaldo P. Machado
*Attorney, Agent, or Firm*—Colton & Stone, Inc.

[57] ABSTRACT

A ladder support for imparting lateral stability to a ladder includes a C-shaped channel member for each side leg of the ladder. A first shoe member is slidably received and lockable longitudinally within each channel and is pivotally connected to a brace member which in turn is pivotally connected to a second shoe member which is also slidably receivable within the channel member. The second shoe members may be positioned outwardly of the ladder on an appropriate support surface and the first shoe members locked in place. The ladder is held by the support assemblies against any lateral forces which might tend to otherwise tip the ladder. When not in use the shoe members are compactly stored within their corresponding channel members.

15 Claims, 8 Drawing Figures

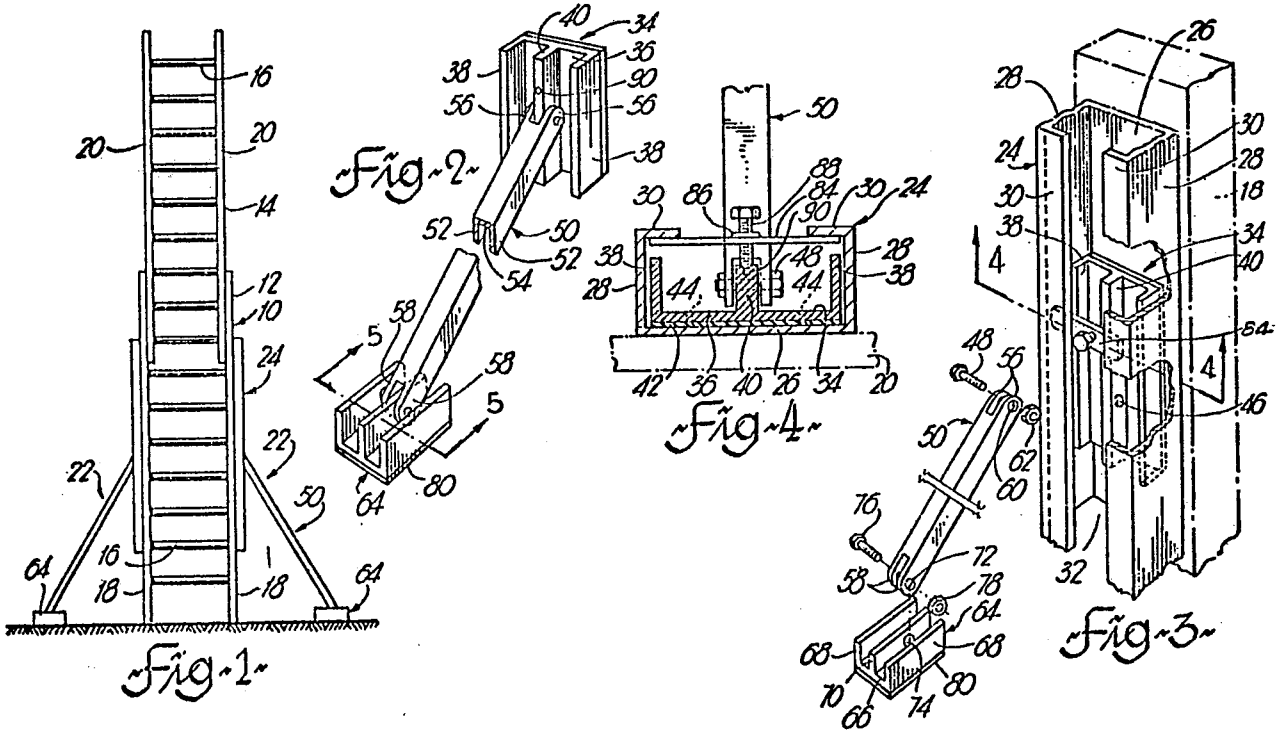

ADJUSTABLE LADDER SUPPORT

The present invention relates in general to support assemblies and in particular to a safety support for a ladder.

BACKGROUND OF THE INVENTION

Extension ladders in particular are very effective in allowing a person to reach a high, otherwise inaccessible position, for painting, repair or any other task. The ladder usually has a pair of leg members spaced apart by a relatively short distance and if the ladder is not completely vertical the chances of it tipping laterally as the person rises thereon increases as the height above the ground increases. It is therefore very desirable to provide a simple, safe, effective means for providing lateral stability to a ladder for use under otherwise unsafe conditions.

Many people have attempted to provide ladder supports in the past. Each attempt has involved relatively complex structures to be added to the ladder. See for example U.S. Pat. Nos. 1,251,761 (Enke, Jan. 1, 1918); 1,385,319 (Enke, July 19, 1921); 3,508,628 (Conrad, Apr. 28, 1970); 3,856,112 (Steward, Dec. 24, 1974) or 3,878,917 (McBride, Apr. 22, 1975). Each structure disclosed therein is either complex or doubtfully effective in providing the desired results.

SUMMARY OF THE PRESENT INVENTION

The ladder support of the present invention aims to avoid the problems of the prior art by providing a ladder support that is relatively easy to produce, easy to install, simple to use and, above all, safe. The ladder support could be sold in a hardware store, and could be installed on an aluminum or wooden ladder by a home handyman with an absolute minimum of labour or skill required. It is simple to operate and is useful to prevent lateral movement of a ladder if it is positioned on a sloping surface, or even a stepped surface, such as a staircase.

The support assembly of the present invention utilizes for each side of the ladder an open-ended C-shaped channel member which is attached to the outside of the leg of the ladder by any conventional means, as by screws. This in essence is the entire assembly work required to attach the safety support to the ladder. A pair of shoe members are slidable within the channel member and a brace member, pivotally attached at each end to an appropriate one of the shoe members, interconnects the shoe members. The upper shoe member is lockable to the channel member at any desired position therealong. In its stored condition, prior to use, both shoes members are housed within the channel member and the stored assembly is very compact, taking little space additional to that required by the ladder itself. To use the ladder support the upper shoe member is unlocked and both shoe members are slid downwardly to release the lower shoe member from the channel member. The lower shoe member is moved outwardly from the ladder and positioned on a safe support surface, such as the ground. Such movement is transmitted via the brace member to the upper shoe member which takes a position in the channel member corresponding to the position of the lower shoe member. The upper shoe member is locked in place and the operation is repeated for the support assembly for the other side of the ladder. With both assemblies in position the ladder is supported against lateral forces which might otherwise tip the ladder and cause an accident.

Broadly speaking therefore the present invention provides a safety support for a ladder having a pair of legs spaced apart by a plurality of rungs, comprising, for each leg of the ladder a channel member for connection of the ladder, the channel member defining a longitudinal slot in one side thereof; a first shoe member slidably receivable within the channel member; means for locking the first shoe member at a desired longitudinal position within the channel member; a second shoe member slidably receivable within the channel member; and a brace member pivotally connected at one end to the first shoe member and at the other end to the second shoe member.

BRIEF DESCRIPTION OF THE DRAWINGS

FIG. 1 shows an extension ladder with the safety support assemblies of the present invention deployed.

FIG. 2 is a perspective view of the shoe members and brace member of one embodiment.

FIG. 3 is an exploded view of the components of the first embodiment of the present invention.

FIG. 4 is a cross-section taken along the line 4—4 of FIG. 3.

DESCRIPTION OF THE PREFERRED EMBODIMENT

Figure 6:
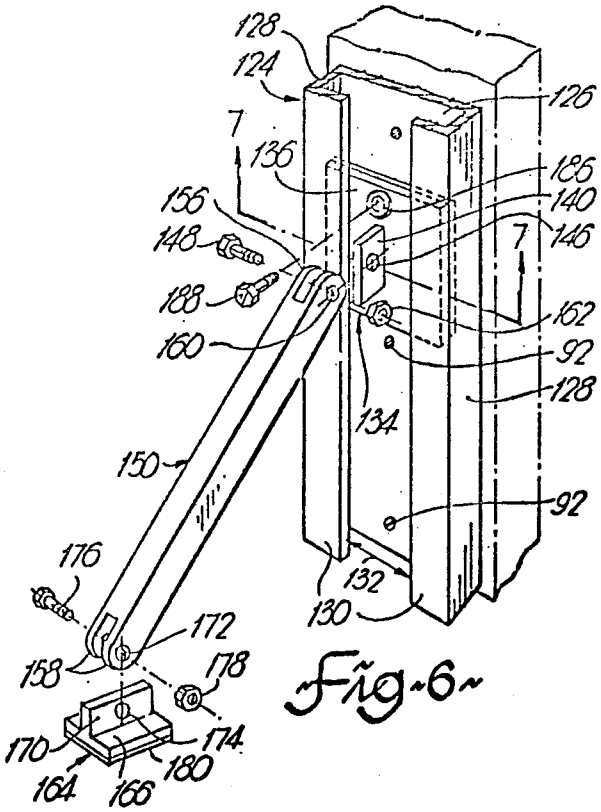
FIG. 6 is an exploded view of the components of the second embodiment of the present invention.

With reference to FIG. 1, an extension ladder 10 having a lower, main ladder section 12 and an upper, movable ladder section 14 is illustrated. Each section has a plurality of spaced rungs 16 fixed to side members 18 or 20 respectively. Other details of the ladder are not required for a full understanding of the present invention. It should also be mentioned that the present invention, while shown in connection with an extension ladder, is equally applicable to other types of ladders, such as step-ladders.

Figure 8:
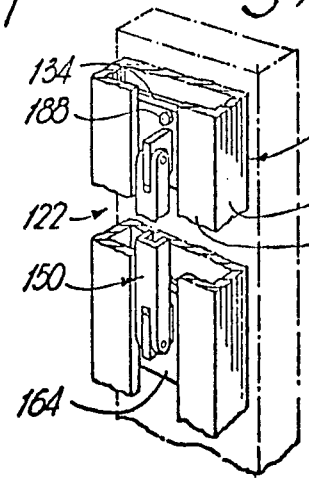
FIG. 8 is a perspective view of the support assembly of the second embodiment shown in its stored position.
Figure 7:
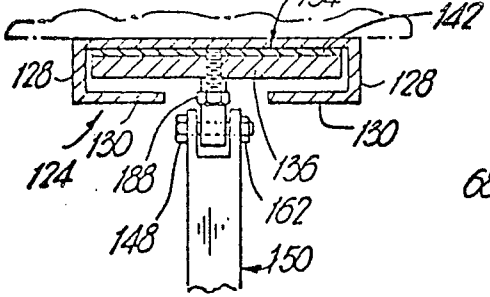
FIG. 7 is a cross-section taken along the line 7—7 of FIG. 6.

Each side member 18 is provided with an adjustable safety support 22. Since each support 22 is identical it will only be necessary to describe one such support in detail. One embodiment is illustrated in FIGS. 2 to 5; a second embodiment is illustrated in FIGS. 6, 7 and 8.

Turning now to FIG. 3 the basic elements of the present safety support are shown in an exploded view. A C-shaped channel member 24 is shown mounted along the outer side surface of a ladder member 18. The mounting may be in any conventional manner, as by screws (not shown). Channel member 24 includes a base portion 26, a pair of opposed, upstanding leg portions 28, and a pair of opposed, inwardly directed flange portions 30 defining a slot 32 therebetween, the slot extending the full length of the channel member, the channel member being open at each end. A first shoe member 34 is provided for sliding reception in channel member 24. As seen in FIGS. 2 and 3, shoe member 34 is of a generally E-shape in cross-section with a base 36, a pair of upstanding outer legs 38 and a central leg 40 which may be thicker than the legs 38. The extent that the legs 38, 40 rise above base 36 is less than the space available between the base portion 26 of channel member 24 and the underside of the flanges 30, as clearly seen in FIG. 3. Shoe member 34 may be provided with a non-slip friction pad 42 which may be adhered to the underside of base 36 or otherwise attached thereto as by rivets 44. The exposed surface of pad 42 may be serrated or otherwise provided with means to increase frictional forces when it is in contact with the base portion 26 of channel 24.

The central leg 40 of shoe member 34 is provided with a transverse bore 46. Pivotally attached to shoe member 34, as by a bolt 48 extending through bore 46, is a brace member 50. As shown in FIG. 2, brace member 50 may be of channel shape in cross-section with legs 52 extending from a base 54. At each end the base is cut back so that the legs 52 define upper and lower lugs or ears 56 and 58 respectively. Upper lugs 56 have a transverse bore 60 extending therethrough to receive bolt 48 and the spacing between lugs 56 is sufficient to receive the central leg 40 of the shoe member 34 therein. Thus as shown in FIG. 2 the brace member 50 is pivotally connected to the shoe member 34 by the bolt 48 passing through the bores 60 in lugs 56 and the bore 46 in central leg 40. A nut 62 is threaded on bolt 48 to secure the connection between the brace member 50 and the shoe member 34.

Figure 5:
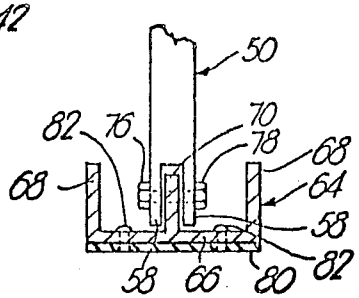
FIG. 5 is a cross-section taken along the line 5—5 of FIG. 2.

According to FIGS. 2, 3 and 5 a second shoe member 64 is pivotally connected to the opposite end of brace member 50 in the same manner as is shoe member 34. Shoe member 64 has a base 66, a pair of upstanding outer legs 68 and a central leg 70, the legs 68 and 70 extending from the base 66. A bolt 76 passes through a bore 72 in lower lugs 58 and a bore 74 in central leg 70 and a nut 78 is used to secure the bolt in place so as to pivotally connect the brace member 50 to the second shoe member 64. A non-slip friction pad 80 similar to pad 42 may be adhered to the base 66 or otherwise connected thereto as by rivets 82.

In order to lock the first shoe member in place within channel member 24, a locking plate 84 is provided. This plate has a length exceeding the width of slot 32 and is receivable in channel member 24. Plate 84 has a central threaded aperture 86 to receive a threaded member such as locking bolt or set screw 88. The central leg 40 of shoe member 34 has a recess 90 in the top surface thereof to receive the end of bolt 88.

It is also noted that the height of legs 68, 70 on the second shoe member 64 is such that the member may be slidably received in channel member 24 in a manner analogous to the first shoe member 34.

The operation or use of the safety support of the present invention will now be described with reference to FIGS. 1, 3 and 8. FIG. 8, while relating to the second embodiment to be described hereinafter, shows that when not in use the first shoe member may be slid upwardly in the channel member and the second shoe member may be slid into the open bottom end of the channel member so that the safety support assumes a compact appearance for storage purposes. The brace member will be received essentially within the slot 32. The first shoe member may be locked to the channel member as described hereinafter to prevent longitudinal movement of the brace member and the shoe members relative to the channel member.

Locking of the first shoe member in the channel member with this embodiment is achieved by rotating bolt 88 in such a manner as to move the locking plate 84 away from the shoe member 34 towards the underside of the flanges 30. Continued rotation of the bolt 88 will force the plate 84 and the shoe member relatively apart to bring the plate 84 into forceful contact with the underside of flanges 30 and to apply an opposite locking force to the shoe member and its friction pad 42. Once locked in this manner the shoe member is restrained from longitudinal movement within the channel member 24. To release the shoe member 34 the bolt 88 is rotated in the opposite manner to move plate 84 away from flanges 30 towards the shoe member. This permits the shoe member to slide freely in the channel member.

To deploy the safety support the first shoe member on one side of the ladder is unlocked and the two shoe members, connected by brace member 50 are slid downwardly in channel member 24 until the second shoe member exits from the channel member. The brace member is then rotated outwardly from the ladder about its pivotal connection with the first shoe member and, with the ladder vertical and in place, the second shoe member 64 is placed on the ground or other such support surface, as seen in FIG. 1. The first shoe member 34 is then locked in position as hereinbefore described.

The safety support 22 on the other side of the ladder is rendered operational in the same manner and the first shoe member 34 thereof is locked in place with the second shoe member 64 thereof resting on the appropriate support surface. It is readily apparent that the safety support on one side need not be adjusted to the same elevation as the safety support on the other side of the ladder. With the safety supports locked in appropriate positions the ladder will be secured laterally even if it is located on a sloping, uneven or stepped surface.

The second embodiment, which operates in the same manner but is somewhat simpler in construction will now be described with reference to FIGS. 6, 7 and 8. The safety support 122 of this embodiment uses a C-shaped channel member 124 attached to a leg of a ladder as by screws 92. Channel member 124 is squatter than channel member 24, having its legs 128 shorter than the legs 28 of channel member 24. Flanges 130 extend inwardly towards each other from the outer edge of legs 128 so as to define a slot 132 therebetween.

FIGS. 6 and 7 illustrate a first shoe member 134 which is slidably received within channel member 124. Shoe member 134 includes a flat base 136 having an upright central leg 140 connected thereto, or integral therewith. A friction pad 142 may be adhered, or otherwise connected to base 136 as in the first embodiment. A brace member 150, substantially identical to brace member 50 is pivotally connected, via upper lugs 156 and bolt 148 extending through alignable bores 160 and 146, to the central leg 140 of the first shoe member 134. A nut 162 may be attached to bolt 148 to secure the pivotal connection between brace member 150 and the first shoe member 134.

A second shoe member 164 is pivotally attached to the other end of the brace member. Shoe member 164 has a base 166 and a central upstanding leg 170 having a transverse bore 174 therein. The lower end of brace member 150 is pivotally connected to the second shoe member 164 via lower lugs 158 and bolt 176 extending through bores 172 and 174, to be secured by nut 178. A friction pad 180 may be adhered or otherwise connected to the underside of base 166.

The means for locking shoe member 134 in place in channel member 124 is illustrated in FIGS. 6 and 7. Base 136 is provided with a threaded through-bore 186 which receive a threaded bolt or set screw 188. As bolt 188 is threaded into bore 186 the leading face thereof will bear on the base portion 126 of channel member 124 and will force the base 136 of the shoe member 134 outwardly until it engages with the underside of the opposed channel flanges 130. Continued tightening of bolt 188 will increase the locking force acting on the base plate 136 to thereby lock the first shoe member in place within the channel member 124.

The operation of the second embodiment is substantially identical to that of the first embodiment. FIG. 8 shows the two shoe members 134, 164 residing within channel member 124 with the upper shoe member locked in place. It is clear that central legs 140, 170 project upwardly through slot 132. To activate the support, bolt 188 is loosened so that the assembly 122 may slide downwardly in channel member 124 to release the second shoe member 164 therefrom. With the ladder in its desired position the second shoe member is moved outwardly of the ladder, pivoting the brace member about bolt 148. The second shoe member is brought to its desired location and the first shoe member is locked in place within channel member 124 by tightening locking bolt 188. It is evident that during the operation of locating second shoe member 164 in its desired position the first shoe member will be subject to sliding motion within the channel member as imposed by the brace member 150.

The support 122 for the other side of the ladder is deployed in the same manner and with both supports in position the ladder is ready for use, supported against lateral forces which could otherwise cause the ladder to tip. The supports of the present invention permit a ladder to be safely used on a sloping surface or even a stepped surface such as a staircase. The component parts may be easily manufactured as from readily available aluminum extrusions. Each support assembly is compact and could be sold in hardware stores for assembly to a ladder by the home handyman. The operation of the support is simple, yet effective, and permits safe use of ladders in situations which would be otherwise unsafe or impossible.

It is evident that a person skilled in the art would be able to alter the specific component structure of the present invention without departing from the spirit thereof. For example it would be possible to use a second shoe member according to the second embodiment in the assembly of the first embodiment and vice versa. It would also be possible to interchange or alter the locking arrangements for locking the first shoe member in the channel member. Hence the protection to be afforded by the present invention should be construed from the appended claims.

The embodiments of the invention in which an exclusive property or privilege is claimed are defined as follows:

1. A safety support for a ladder having a pair of legs spaced apart by a plurality of rungs, comprising, for each leg of the ladder: a channel member for connection to the ladder, said channel member defining a longitudinal slot in one side thereof; a first shoe member slidably receivable within said channel member; means for locking said first shoe member at a desired longitudinal position within said channel member; a second shoe member slidably receivable within said channel member; and a brace member pivotally connected at one end to said first shoe member and at the other end to said second shoe member.

2. The safety support of claim 1 wherein said channel member is of C-shape in cross-section, having a base portion, a pair of spaced apart leg portions extending outwardly from said base portion and a pair of flange portions, each flange portion extending towards the other flange portion from a corresponding leg portion to define said slot therebetween.

3. The safety support of claim 2 wherein said first shoe member is of E-shape in cross-section, having a base, a pair of upstanding outer legs and a central leg alignable with said slot, said brace member being pivotally connected at said one end to said central leg.

4. The safety support of claim 3 wherein said second shoe member is of E-shape in cross-section, having a base, a pair of upstanding outer legs and a central leg alignable with said slot, said brace member being pivotally connected at said other end to said central leg of said second shoe member.

5. The safety support of claim 3 and including a non-slip friction pad affixed to the underside of said base.

6. The safety support of claim 4 and including a non-slip friction pad affixed to the underside of said second shoe member base.

7. The safety support of claim 3 or claim 4 wherein said locking means includes a locking plate having a central threaded aperture therein, said plate being wider than said slot and receivable within said channel; a locking bolt threadable in said aperture; and a recess in the central leg of said first shoe member to receive said bolt, rotation of said bolt moving said locking plate into engagement with said flanges to lock said first shoe member in said channel member.

8. The safety support of claim 2 wherein said first shoe member has a base and a central leg thereon alignable with said slot, said brace member being pivotally connected at said one end to said central leg.

9. The safety support of claim 8 wherein said second shoe member has a base and a central leg thereon alignable with said slot, said brace member being pivotally connected at said other end to said central leg of said second base member.

10. The safety support of claim 8 and including a non-slip friction pad affixed to said base.

11. The safety support of claim 9 and including a non-slip friction pad affixed to the underside of said second shoe base.

12. The safety support of claim 8 or claim 9 wherein said locking means includes a threaded aperture in the base of said first shoe member and a threaded locking bolt receivable in said aperture, rotation of said bolt moving said first shoe member base into engagement with said flanges to lock said first shoe member in said channel member.

13. The safety support of claim 1 wherein said brace member is of channel shape in cross-section and defines a pair of lugs at each end thereof, each pair of lugs having a bore therethrough to receive a pivot pin, the pivot pin at said one end engaging said first shoe member to form the pivotal connection therewith and the pivot pin at said other end engaging said second shoe member to form the pivotal connection therewith.

14. A safety support for a ladder having a pair of legs spaced apart by a plurality of rungs, comprising, for each leg of the ladder: a channel member of C-shape in cross-section with a base portion attachable to the ladder leg, a pair of leg portions extending from said base portion and a pair of opposed flanges extending each from a corresponding leg portion, parallel to said base portion to define a longitudinally extending slot therebetween; a first shoe member of E-shape in cross-section slidably receivable in said channel member and having a base, a pair of outer legs extending from said base and a central leg alignable with said slot; said central leg having a recess therein; a locking plate receivable in said channel member and having a threaded aperture therein alignable with said recess; a threaded locking bolt receivable in said aperture and engagable with said recess; a second shoe member of E-shape in cross-section slidably receivable in said channel member and having a base, a pair of outer legs extending from the base thereof and a central leg alignable with said slot; and a brace member interconnecting said shoe members, said brace member being pivotally connected at one end to the central leg of said first shoe member and being pivotally connected at the other end to the central leg of said second shoe member.

15. A safety support for a ladder having a pair of legs spaced apart by a plurality of rungs, comprising, for each leg of said ladder: a channel member of C-shape in cross-section with a base portion attachable to the ladder leg; a pair of leg portions extending from said base portion and a pair of opposed flanges extending each from a corresponding leg portion, parallel to said base portion, to define a longitudinally extending slot therebetween; a first shoe member slidably receivable in said channel member and having a base and a central leg thereon alignable with said slot; a threaded aperture in said base; a threaded locking bolt receivable in said aperture; a second shoe member slidably receivable in said channel member and having a base and a central leg thereon alignable with said slot; and a brace member interconnecting said shoe members, said brace member being pivotally connected at one end to the central leg of said first shoe member and being pivotally connected at the other end to the central leg of said second shoe member.

* * * * *